US009741295B2

(12) United States Patent
Kimoto

(10) Patent No.: US 9,741,295 B2
(45) Date of Patent: Aug. 22, 2017

(54) IMAGE DISPLAY APPARATUS AND METHOD FOR CONTROLLING THE SAME

(71) Applicant: CANON KABUSHIKI KAISHA, Tokyo (JP)

(72) Inventor: Tatsuya Kimoto, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 219 days.

(21) Appl. No.: 14/316,458

(22) Filed: Jun. 26, 2014

(65) Prior Publication Data

US 2015/0002556 A1 Jan. 1, 2015

(30) Foreign Application Priority Data

Jun. 28, 2013 (JP) ..... 2013-136170
May 22, 2014 (JP) ..... 2014-106156

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 3/3406* (2013.01); *G09G 2320/0626* (2013.01); *G09G 2380/08* (2013.01)

(58) Field of Classification Search
CPC ..... G09G 3/342; G09G 3/3406; G09G 2320/0626
USPC ..... 345/89, 102, 690
See application file for complete search history.

(56) References Cited

U.S. PATENT DOCUMENTS 6,870,525 B2 * 3/2005 Kawabata ..... G02F 1/133605 345/102
7,268,759 B2 * 9/2007 Hsu ..... G09G 3/3406 345/102
2008/0238860 A1 * 10/2008 Onodera ..... G09G 3/3413 345/102
2009/0085862 A1 * 4/2009 Takaku ..... G09G 3/3406 345/102
2010/0073276 A1 * 3/2010 Koike ..... G09G 3/3426 345/102

(Continued)

FOREIGN PATENT DOCUMENTS

JP 2007-183397 A 7/2007
JP 2010-085807 A 4/2010
JP 2012-14004 A 1/2012

*Primary Examiner* — Chanh Nguyen
*Assistant Examiner* — Yuzhen Shen
(74) *Attorney, Agent, or Firm* — Canon USA, Inc., IP Division

(57) ABSTRACT

An image display apparatus includes a display unit to display an image based on image data on a screen including a plurality of areas, a light emitting unit to individually control emission brightness for each area, a calculation unit to calculate emission brightness of an image displayed on the screen for each area based on the image data, a measurement unit disposed opposing the screen and to measure a characteristic value relating to display characteristics of the display unit, and a control unit to determine whether emission brightness of a first area opposing the measurement unit is lower than a first value when the measurement unit measures the characteristic value and to set the emission brightness to a value equal to or greater than the first value when the emission brightness of the light emitting unit for the first area is lower than the first value.

22 Claims, 9 Drawing Sheets

(56) References Cited

U.S. PATENT DOCUMENTS

| | | | | |
|---|---|---|---|---|
| 2010/0214325 | A1* | 8/2010 | Koyama | G09G 3/3406<br>345/690 |
| 2010/0225574 | A1* | 9/2010 | Fujiwara | G09G 3/3426<br>345/102 |
| 2011/0128435 | A1* | 6/2011 | Ikeda | H04N 5/2351<br>348/362 |
| 2014/0035960 | A1* | 2/2014 | You | G09G 3/3413<br>345/690 |

* cited by examiner

IMAGE DISPLAY APPARATUS AND METHOD FOR CONTROLLING THE SAME

BACKGROUND OF THE INVENTION

Field of the Invention

The present disclosure generally relates to imaging and, more particularly, to an image display apparatus and a method for controlling the image display apparatus.

Description of the Related Art

In recent years, there has been a user demand for image display apparatuses with high display performance, and a user demand for maintaining accuracy in gradation expression has been increased. To address such demands, as discussed in Japanese Patent Application Laid-Open No. 2012-14004, such an image display apparatus is becoming more widespread that includes a function of automatically measuring a characteristic value relating to display characteristics of a display unit (e.g., display colors and display luminance of the display unit) periodically with a measurement unit, such as a sensor, provided opposing the display unit and automatically calibrating the display characteristics in a case where the obtained characteristic value deviates from a predetermined value (i.e., calibration function).

In addition, in recent years, there has been a technique in which, in a liquid crystal display apparatus, a emission intensity of a backlight formed by a light source, such as a plurality of light emitting diodes (LEDs), is controlled in accordance with image data in each of a plurality of emission areas of the backlight corresponding to a plurality of areas constituting a screen. There is also a technique in which, in addition to controlling the emission intensity of the backlight in accordance with the image data in each of the emission areas, the image data is corrected in accordance with the emission intensity level. These techniques are referred to as local dimming control techniques, and the use of the local dimming control techniques makes it possible to improve a contrast in a displayed image and to suppress a misadjusted black level.

In a case where calibration control is carried out in an image display apparatus provided with the local dimming control technique (having a local dimming control function), the following problem may arise. The problem that may arise in a case where the calibration control is carried out in a liquid crystal display apparatus having the local dimming control function will be described with reference to FIGS. 9A and 9B. A liquid crystal display apparatus 1, which is provided with the local dimming control function, includes a sensor unit 2. The sensor unit 2 measures a characteristic value relating to display characteristics of the liquid crystal display apparatus 1 in an area 3 (hereinafter, referred to as a measurement target area 3) directly under the sensor unit 2, and a control unit (not illustrated) of the liquid crystal display apparatus 1 derives the display characteristics through calculation processing based on the obtained characteristic value.

More specifically, colorimetric patches of different densities are successively displayed on a display unit 4, and the sensor unit 2 measures chromaticity values or luminance values of the colorimetric patches as the characteristic value. The control unit then derives the display characteristics through the calculation processing based on the obtained characteristic value. The liquid crystal display apparatus 1 then automatically calibrates the display characteristics (i.e., carries out calibration). In addition, as illustrated in FIG. 9A, the image displayed on the liquid crystal display apparatus 1 is dark black in color in the measurement target area 3 and in an area around the measurement target area 3. In such a case, a backlight (not illustrated) included in the liquid crystal display apparatus 1 is controlled so that its emission intensity is reduced in the measurement target area 3 (i.e., local dimming control).

In other words, in a case where an image displayed on the measurement target area 3 is dark, the sensor unit 2 measures the characteristic value of the display unit 4 in a state in which the emission intensity is reduced in the measurement target area 3. However, depending on the performance of the sensor unit 2, when the emission intensity of the measurement target area 3 falls below a predetermined value, even if the colorimetric patches are displayed successively on the display unit 4, a difference in gradation among the colorimetric patches may not be able to be measured at a sufficient level due to insufficient luminance of the colorimetric patches. As a result, the accuracy of the calibration may be degraded. In addition, as illustrated in FIG. 9B, if the emission intensity of only the measurement target area 3, of which the emission intensity has been low, is raised excessively in order to obtain a more accurate measurement value, a so-called misadjusted black level may occur in which a black image is displayed in a whitish manner only in the measurement target area 3 due to the raised emission intensity. This causes the quality of the displayed image to be degraded, and the primary effect of the local dimming control function cannot be obtained. In particular, when a diagnostic image is displayed on a liquid crystal display apparatus for making a diagnosis in a medical site, the aforementioned misadjusted black level is extremely annoying to doctors.

SUMMARY OF THE INVENTION

The present disclosure is directed to an image display apparatus capable of suppressing degradation of the quality of a display image and of measuring a characteristic value relating to display characteristics of a display unit with high accuracy.

According to an aspect of the present disclosure, an image display apparatus includes a display unit configured to display an image based on image data on a screen including a plurality of areas, a light emitting unit capable of individually controlling emission brightness for each of the areas, a calculation unit configured to calculate emission brightness of an image displayed on the screen for each of the areas based on the image data, a measurement unit disposed opposing the screen, and configured to measure a characteristic value relating to display characteristics of the display unit, and a control unit configured to determine whether emission brightness of a first area opposing the measurement unit is lower than a first value when the measurement unit measures the characteristic value, and to set the emission brightness to a value equal to or greater than the first value in a case where the emission brightness of the light emitting unit on the first area is lower than the first value.

According to another aspect of the present disclosure, a method for controlling an image display apparatus that includes a display unit configured to display an image on a screen including a plurality of areas based on image data and a light emitting unit capable of independently controlling emission brightness for each of the areas, includes calculating emission brightness of an image displayed on the screen for each of the areas based on the image data measuring a characteristic value relating to display characteristics of the display unit by using a measurement unit disposed opposing the screen, determining whether emission brightness for a first area opposing the measurement unit is lower than a first value when the measurement unit measures the characteristic value, and setting the emission brightness to a value that is equal to or greater than the first value in a case where the emission brightness of the light emitting unit for the first area is lower than the first value.

According to the aspects of the present disclosure, the characteristic value of the display unit can be measured with high accuracy while degradation of the quality of the displayed image is suppressed to a minimum.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings.

Hereinafter, an image display apparatus and a method for controlling an image display apparatus according to a first exemplary embodiment of the present disclosure will be described.

<Monitor 100>

Figure 1:
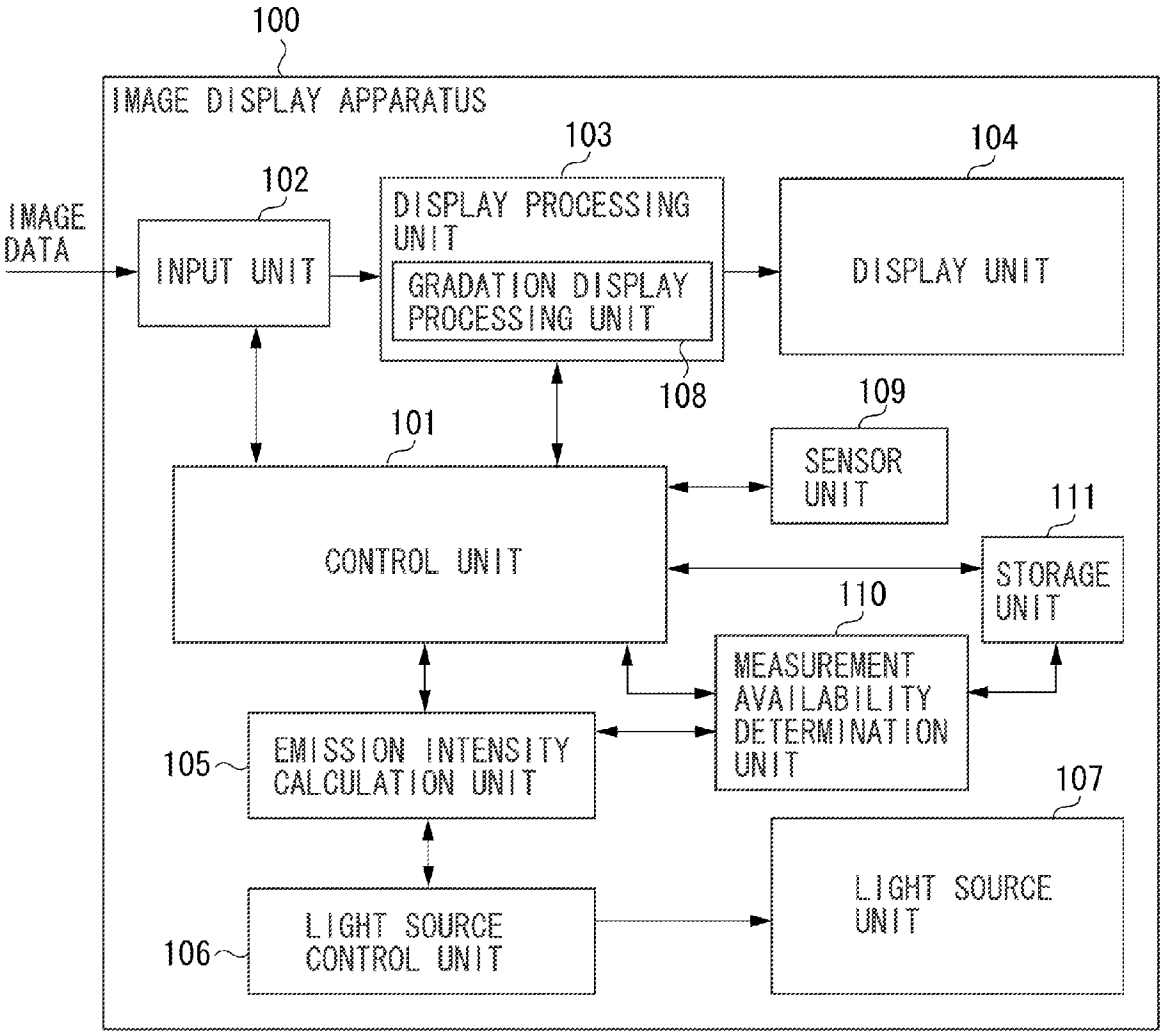
FIG. 1 is a block diagram illustrating an image display apparatus according to a first exemplary embodiment of the present disclosure.

FIG. 1 is a block diagram illustrating an image display apparatus according to a first exemplary embodiment. With reference to FIG. 1, an image display apparatus 100 according to the first exemplary embodiment will be described. The image display apparatus 100 displays an image based on image data on a display unit 104. In the first exemplary embodiment, a monitor, which is a liquid crystal display apparatus, is employed as an example of the image display apparatus 100. Hereinafter, the image display apparatus 100 will be referred to as the "monitor 100". As used herein, the term "unit" generally refers to any combination of software, firmware, hardware, or other component that is used to effectuate a purpose.

As illustrated in FIG. 1, the monitor 100 includes a control unit 101, an input unit 102, a display processing unit 103, the display unit 104, an emission intensity calculation unit 105, a light source control unit 106, a light source unit 107, a gradation display processing unit 108, a sensor unit 109, a measurement availability determination unit 110, and a storage unit 111.

The control unit 101 controls an overall operation of the monitor 100 in accordance with a computer program stored in the storage unit 111. The control unit 101 is configured, for example, of a central processing unit (CPU), a memory, and so forth. The input unit 102 supplies image data, which is supplied from an external apparatus (not illustrated) through a communication interface or the like, to the display processing unit 103. The display processing unit 103 converts the image data supplied from the input unit 102 to a format that can be displayed by the display unit 104. The converted image data is supplied to the display unit 104. The display processing unit 103 includes the gradation display processing unit 108.

The display unit 104 is configured of a display panel, such as a liquid crystal panel. The display unit 104 can display the image data supplied from the display processing unit 103. More specifically, in the present exemplary embodiment, the display unit 104 includes a plurality of liquid crystal elements, and the light transmission of each liquid crystal element (i.e., the aperture ratio of the liquid crystal) is changed in accordance with a gradation value of the image data. Each of the liquid crystal elements transmits light emitted from the light source unit 107 at the changed light transmission, and thus the image is displayed on a display area (screen) of the display unit 104.

The emission intensity calculation unit 105 is a calculation device that calculates an emission intensity (emission luminance; emission brightness) of each luminous area of the light source unit 107 based on image data supplied from the control unit 101. More specifically, the emission intensity calculation unit 105 calculates the emission intensity of each luminous area based on the brightness of the image data in each luminous area and supplies the calculated emission intensity to the light source control unit 106. To be more specific, the emission intensity calculation unit 105 calculates the luminous intensities so that a luminous area corresponding to a dark portion of the image data has a lower emission intensity and an emission area corresponding to a bright portion of the image data has a higher emission intensity, and supplies the calculated luminous intensities to the light source control unit 106. Thus, the misadjusted black level in the image data displayed on the display unit 104 is suppressed, and the contrast is enhanced. The emission intensity calculation unit 105 also carries out processing of changing a lower limit value when calculating the emission intensity, based on an instruction from the measurement availability determination unit 110.

Figure 5A:
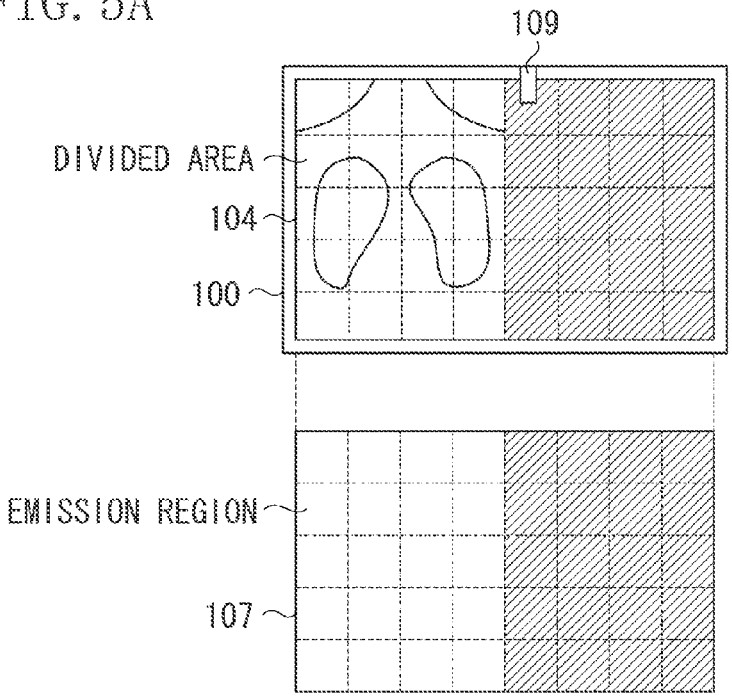
FIGS. 5A and 5B are diagrams illustrating an overview of control according to a second exemplary embodiment of the present disclosure.
Figure 5B:
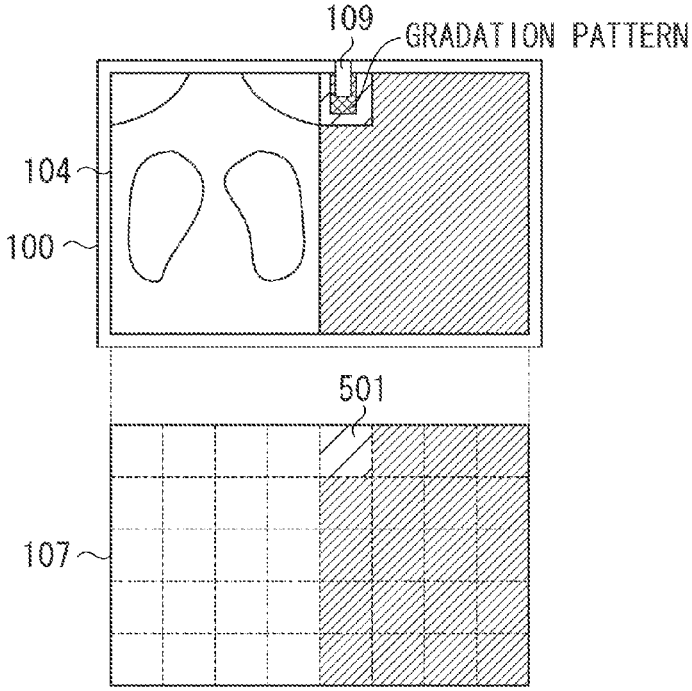

The light source control unit 106 is a calculation device that controls the light source unit 107 based on the emission intensity, supplied from the emission intensity calculation unit 105, of each emission area of the light source unit 107. The light source unit 107 is a light emission device configured, for example, of a white LED light source that emits light and irradiates the display unit 104 with the light from the rear side of the display unit 104. A backlight, for example, is used as the light source unit 107 in the present exemplary embodiment. The light source unit 107 is divided into a plurality of emission areas, as illustrated in FIGS. 5A and 5B, and the light source control unit 106 can control the emission intensity of each of the emission areas independently from one another. More specifically, the light source control unit 106 sets the plurality of emission areas of the light source unit 107 so that the light source unit 107 is divided into the emission areas in units that are substantially the same as the units in which the display unit 104 is divided into display areas. In other words, the light source control unit 106 can control the emission intensity of the light source unit 107 independently for each of the emission areas corresponding to the plurality of divided areas forming the screen of the display unit 104. Thus, the light source control unit 106 controls the emission intensity of each of the divided areas of the light source unit 107 (i.e., the emission intensity of each of the emission areas of the light source unit 107) in accordance with the emission intensity of each of the divided areas based on the image data. In other words, the local dimming control of the monitor 100 of the present exemplary embodiment is possible. It is to be noted that the LEDs forming the light source unit 107 are not limited to the white LEDs. For example, the light source unit 107 may be configured of RGB LEDs that are each configured of three LEDs, i.e., a red LED (RLED), a green LED (GLED), and a blue LED (BLED).

The gradation display processing unit 108 displays, on the display unit 104, a gradation pattern (a plurality of colorimetric patches of difference densities) for measuring the characteristic value relating to the display characteristics of the display unit 104 (display characteristics of the monitor 100) using the sensor unit 109. The sensor unit 109 is integrated with the monitor 100 and disposed opposing the front face of the display unit 104. The sensor unit 109 measures the characteristic value relating to the display characteristics of the display unit 104, or information relating, for example, to the display color and the display luminance (e.g., the chromaticity value and the luminance value of the displayed image). The sensor unit 109 outputs the characteristic value obtained through the measurement to the control unit 101. The control unit 101 then derives the display characteristics of the display unit 104 through calculation processing based on the characteristic value output from the sensor unit 109. The display characteristics of the display unit 104 will be described below.

The measurement availability determination unit 110 is a calculation device that determines the measurement availability based on the emission intensity, calculated by the emission intensity calculation unit 105, of a luminous area directly beneath the sensor unit 109 in the light source unit 107. The emission area directly beneath the sensor unit 109 in the light source unit 107 is an emission area that corresponds to a divided area in the screen on which the display characteristics are to be measured (i.e., a measurement target emission area). The storage unit 111 includes a non-volatile memory, such as an electrically erasable programmable read only memory (EEPROM). The storage unit 111 further includes a volatile memory, such as a random access memory (RAM), which functions as a work area of the control unit 101.

<Automatic Calibration Processing>

Figure 2:
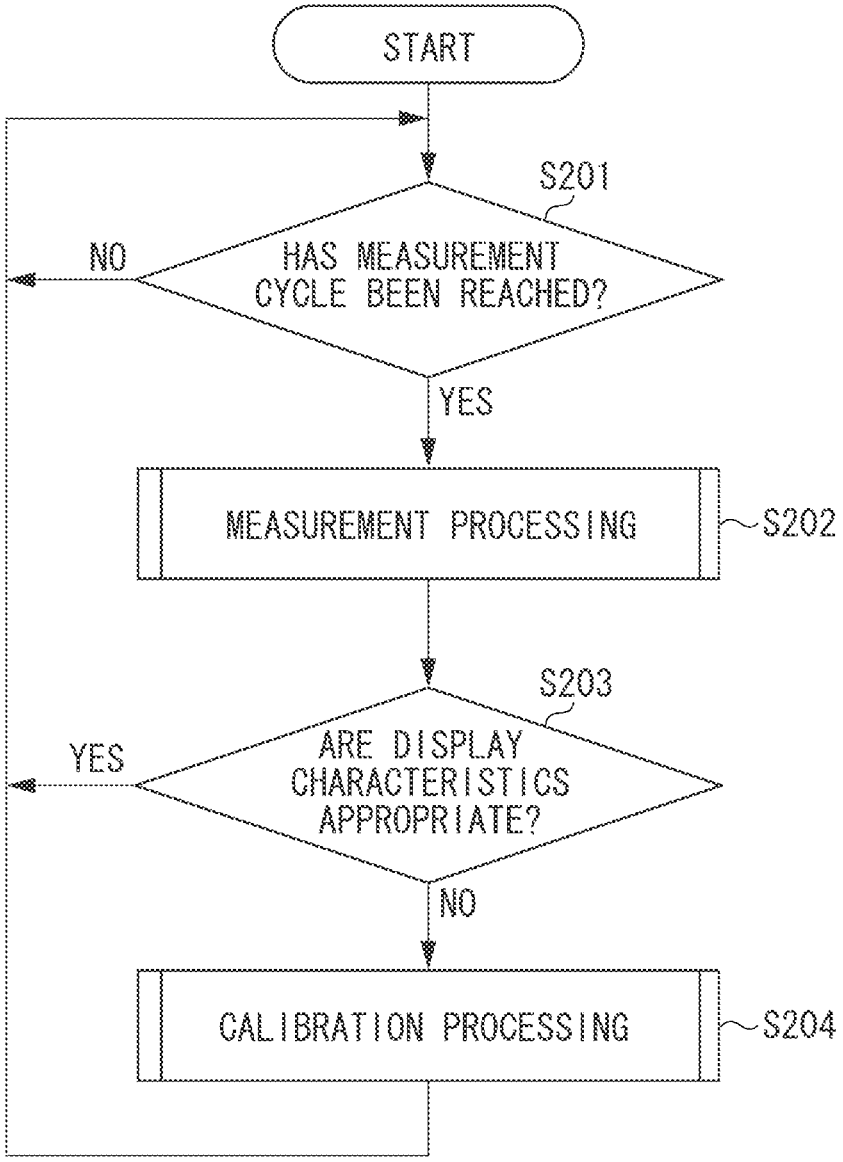
FIG. 2 is a flowchart illustrating automatic calibration processing according to the first exemplary embodiment of the present disclosure.

Referring to a flowchart illustrated in FIG. 2, automatic calibration processing carried out in the monitor 100 according to the first exemplary embodiment will now be described. FIG. 2 illustrates a flowchart illustrating an example of the automatic calibration processing carried out in the monitor 100 according to the present exemplary embodiment. In the automatic calibration processing, the monitor 100 automatically measures the display characteristics of the display unit 104 at a predetermined cycle and calibrates the display unit 104 if it is determined that the gradation is not appropriate. Although, in the calibration processing described in the present exemplary embodiment, gradation characteristics relating to gamma characteristics are measured as the display characteristics and are calibrated, the calibration processing is not limited thereto. For example, the calibration processing may be carried out on other characteristics, such as luminance characteristics and color characteristics. The automatic calibration processing is controlled by the control unit 101 executing a computer program stored in the storage unit 111 when the power supply of the monitor 100 is on.

In step S5201, the control unit 101 determines whether a measurement cycle has been reached (i.e., whether a timing at which processing of measuring the display characteristics is to be carried out has been reached). Whether the measurement cycle has been reached is determined by using a software timer included in the computer program stored in the storage unit 111. The software timer is well known, and thus descriptions thereof will be omitted. In addition, the measurement cycle is stored in advance in the storage unit 111. If the measurement cycle has been reached (YES in step S201), the processing proceeds from step S201 to step S202. On the other hand, if the measurement cycle has not been reached (NO in step S201), the processing repeats step S201 until the measurement cycle is reached.

If the measurement cycle has been reached (YES in step S201), in step S202, the monitor 100 automatically carries out processing of measuring the display characteristics of the display unit 104 (hereinafter, simply referred to as measurement processing), and the processing then proceeds from step S202 to step S203. The measurement processing in step S202 will be described below in detail. In step S203, the control unit 101 determines whether the display characteristics of the display unit 104 obtained in step S202 are appropriate. The determination here is made by comparing the display characteristics of the display unit 104 obtained in step S202 with target display characteristics stored in advance in the storage unit 111. More specifically, the control unit 101 compares a difference between the target display characteristics stored in the storage unit 111 and the display characteristics of the display unit 104 obtained in step S202 with a predetermined threshold value stored in advance in the storage unit 111. If the difference is greater than the threshold value, the control unit 101 determines that the obtained display characteristics are not appropriate. On the other hand, if the difference is equal to or less than the threshold value, the control unit 101 determines that the obtained display characteristics are appropriate. If the display characteristics are not appropriate (NO in step S203), the processing proceeds from step S203 to step S204. On the other hand, if the display characteristics are appropriate (YES in step S203), the processing proceeds from step S203 to step S201.

If the display characteristics are not appropriate (NO in step S203), in step S204, the monitor 100 automatically carries out the calibration processing of the display characteristics of the display unit 104, and the processing then proceeds from step S204 to step S201. In the calibration processing in step S204, the monitor 100 updates a look-up table (LUT) stored in advance in the storage unit 111 based on the display characteristics of the display unit 104 obtained in step S202. The calibration processing is well known, and thus descriptions thereof will be omitted.

<Processing of Measuring Display Characteristics>

Figure 3:
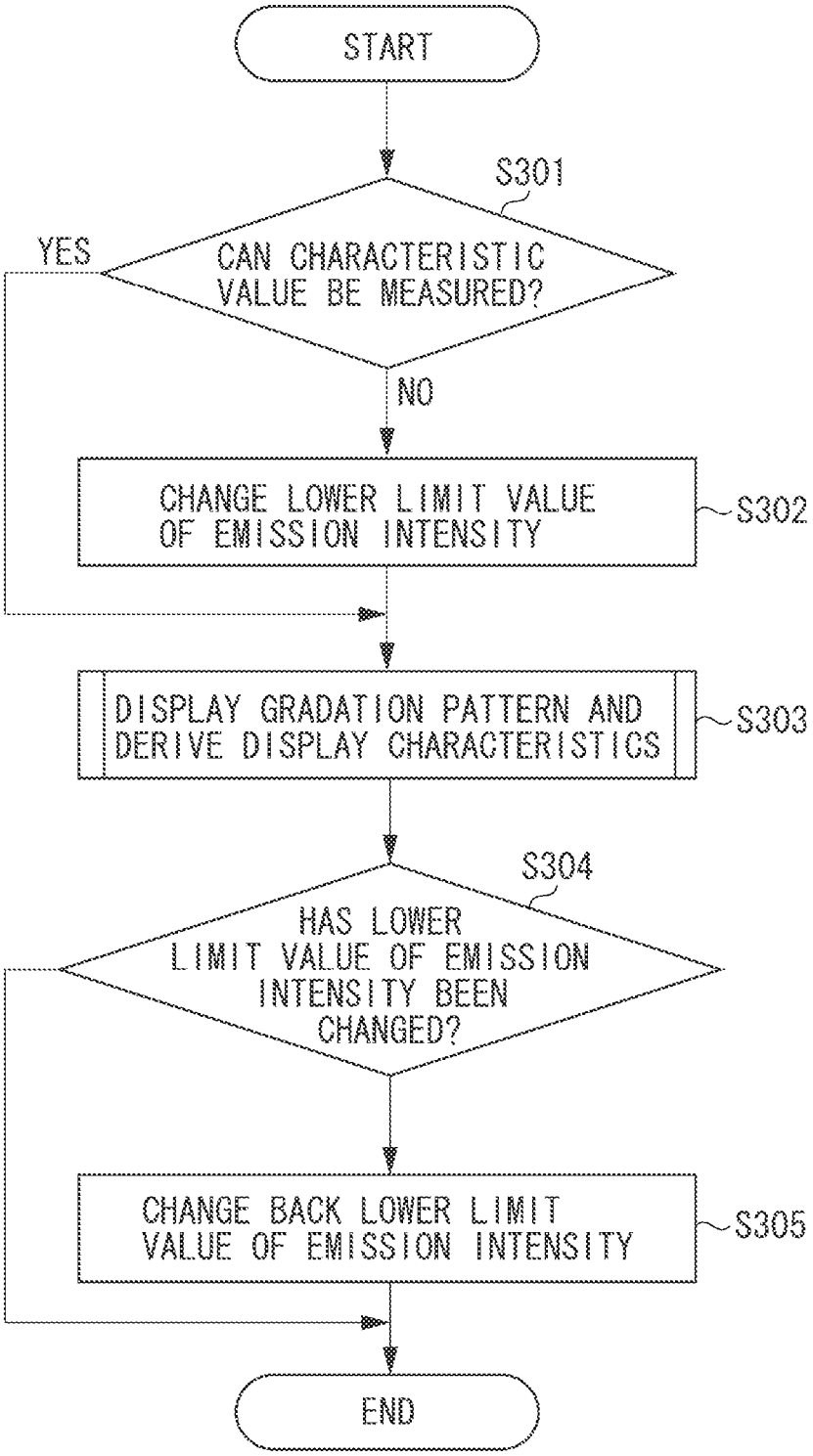
FIG. 3 is a flowchart illustrating processing for measuring a characteristic value of a display unit according to the first exemplary embodiment of the present disclosure.

The processing of measuring the display characteristics of the display unit 104 carried out in the monitor 100 according to the first exemplary embodiment will now be described with reference to FIG. 3. The measurement processing is carried out in step S202 of the automatic calibration processing described with reference to FIG. 2. FIG. 3 is a flowchart illustrating an example of the measurement processing carried out in the monitor 100 according to the first exemplary embodiment. In the measurement processing, the monitor 100 adjusts the emission intensity of the light source unit 107 as necessary and measures the display characteristics of the display unit 104.

In step S301, the measurement availability determination unit 110 determines whether the sensor unit 109 can measure the characteristic value of the display unit 104. More specifically, the control unit 101 instructs the measurement availability determination unit 110 to determine whether the sensor unit 109 can measure the characteristic value of the display unit 104. Based on the instruction from the control unit 101, the measurement availability determination unit 110 obtains the emission intensity, which has been obtained through the measurement carried out by the sensor unit 109, of the measurement target luminous area in the light source unit 107 from the emission intensity calculation unit 105. The measurement availability determination unit 110 then compares the emission intensity obtained from the emission intensity calculation unit 105 with a lower limit value (i.e., B3, which will be described below) of the emission intensity, stored in the storage unit 111, at which the sensor unit 109 can measure the characteristic value of the display unit 104.

If the emission intensity obtained from the emission intensity calculation unit 105 is equal to or greater than the lower limit value of the emission intensity at which the sensor unit 109 can measure the characteristic value of the display unit 104, the measurement availability determination unit 110 determines that the sensor unit 109 can measure the characteristic value of the display unit 104, and notifies the control unit 101 of the result of the determination. If the emission intensity obtained from the emission intensity calculation unit 105 is lower than the lower limit value of the emission intensity at which the sensor unit 109 can measure the characteristic value of the display unit 104, the measurement availability determination unit 110 determines that the sensor unit 109 cannot measure the characteristic value of the display unit 104, and notifies the control unit 101 of the result of the determination.

In other words, in step S301, the measurement availability determination unit 110 determines whether, at the time of measuring the characteristic value with the sensor unit 109, the emission intensity of the measurement target emission area is less than the lower limit value (B3) of the emission intensity at which the sensor unit 109 can measure the characteristic value of the display unit 104. The lower limit value of the emission intensity at which the sensor unit 109 can measure the characteristic value of the display unit 104 is determined uniquely in accordance with the performance of the display unit 104 and the sensor unit 109. If the sensor unit 109 can measure the characteristic value of the display unit 104 (YES in step S301), the control unit 101 stores, in the storage unit 111, the result of the determination obtained from the measurement availability determination unit 110, and the processing then proceeds from step S301 to step S303. On the other hand, if the sensor unit 109 cannot measure the characteristic value of the display unit 104 (NO in step S301), the control unit 101 stores, in the storage unit 111, the result of the determination obtained from the measurement availability determination unit 110, and the processing then proceeds from step S301 to step S302.

If the sensor unit 109 cannot measure the characteristic value of the display unit 104 (NO in step S301), the emission intensity of the measurement target emission area in the light source unit 107 needs to be controlled in order to enable the sensor unit 109 to measure the characteristic value of the display unit 104. Thus, in step S302, lower limit value changing processing is carried out in which, with regard to a control range of the emission intensity of the measurement target emission area in the light source unit 107, a lower limit value of the control range of the emission intensity of the measurement target emission area in the light source unit 107 is changed to a lower limit value of the emission intensity, stored in the storage unit 111, at which the sensor unit 109 can measure the characteristic value of the display unit 104. More specifically, with regard to the control range of the emission intensity of the measurement target emission area in the light source unit 107, the control unit 101 instructs the emission intensity calculation unit 105 to change the lower limit value of the control range of the emission intensity of the measurement target emission area in the light source unit 107 to the lower limit value of the emission intensity, stored in the storage unit 111, at which the sensor unit 109 can measure the characteristic value of the display unit 104. Based on the instruction from the control unit 101, the emission intensity calculation unit 105 recalculates the emission intensity of the measurement target emission area in the light source unit 107 and notifies the light source control unit 106 of the result. Meanwhile, the control range will be described below in detail.

The light source control unit 106 controls light to be emitted from the measurement target emission area in the light source unit 107 at the emission intensity obtained from the emission intensity calculation unit 105, and the processing then proceeds from step S302 to step S303. In this manner, in step S302, the light source control unit 106 controls the emission intensity of the measurement target emission area in the light source unit 107 to reach or exceed the lower limit value of the emission intensity, stored in the storage unit 111, at which the sensor unit 109 can measure the characteristic value of the display unit 104. This enables the sensor unit 109 to measure the characteristic value of the display unit 104. On the other hand, if, in step S301, the sensor unit 109 can measure the characteristic value of the display unit 104 (YES in step S301), the sensor unit 109 can measure the characteristic value of the display unit 104 without the emission intensity of the measurement target emission area in the light source unit 107 being changed.

In step S303, the sensor unit 109 measures the characteristic value of the display unit 104, and the control unit 101 derives the display characteristics of the display unit 104 through calculation processing based on the obtained characteristic value. More specifically, the control unit 101 instructs the gradation display processing unit 108 to display, on the display unit 104, a gradation pattern (a plurality of colorimetric patches of different densities) for measuring the characteristic value of the display unit 104 using the sensor unit 109. In addition, the control unit 101 instructs the sensor unit 109 to measure the characteristic value of the display unit 104. Thus, the gradation display processing unit 108 successively displays a predetermined number of colorimetric patches on the display unit 104, and the sensor unit 109 measures the characteristic value of the display unit 104 and outputs the obtained characteristic value to the control unit 101. The control unit 101 then derives the display characteristics of the display unit 104 through predetermined calculation processing based on the characteristic value output from the sensor unit 109. The method for deriving the display characteristics is well known, and thus descriptions thereof will be omitted in the present exemplary embodiment. Upon the control unit 101 deriving the display characteristics of the display unit 104, the processing proceeds from step S303 to step S304.

In a case where the emission intensity of the measurement target emission area in the light source unit 107 has been changed, the changed emission intensity needs to be changed back to the emission intensity held prior to the change based on the image data (i.e., original emission intensity) after the measurement processing of the sensor unit 109 ends. Thus, in step S304, the control unit 101 determines whether the lower limit value of the emission intensity of the measurement target emission area in the light source unit 107 has been changed. More specifically, the control unit 101 reads out the result of the determination stored in the storage unit 111 in step S301 and determines whether the lower limit value of the control range of the emission intensity of the measurement target emission area in the light source unit 107 has been changed based on the stated result of the determination. To be more specific, if, in step S301, the measurement availability determination unit 110 has determined that the sensor unit 109 cannot measure the characteristic value of the display unit 104 (NO in step S301), in step S304, the control unit 101 determines that the lower limit value of the control range of the emission intensity of the measurement target emission area in the light source unit 107 has been changed. On the other hand, if, in step S301, the measurement availability determination unit 110 has determined that the sensor unit 109 can measure the characteristic value of the display unit 104 (YES in step S301), in step S304, the control unit 101 determines that the lower limit value of the control range of the emission intensity of the measurement target emission area in the light source unit 107 has not been changed. If the control unit 101 determines that the lower limit value of the control range of the emission intensity of the measurement target emission area in the light source unit 107 has been changed (YES in step S304), the processing proceeds from step S304 to step S305. On the other hand, if the control unit 101 determines that the lower limit value of the control range of the emission intensity of the measurement target emission area in the light source unit 107 has not been changed (NO in step S304), the processing is terminated.

If the control unit 101 determines that the lower limit value of the control range of the emission intensity of the measurement target emission area in the light source unit 107 has been changed (YES in step S304), in step S305, the control unit 101 instructs the emission intensity calculation unit 105 to change back the control range of the emission intensity of the measurement target luminous area in the light source unit 107 to the control range held prior to the measurement processing (i.e., original control range). Based on the instruction from the control unit 101, the emission intensity calculation unit 105 calculates the emission intensity of the measurement target emission area in the light source unit 107 through the original control range, and notifies the light source control unit 106 of the result. The light source control unit 106 controls light to be emitted from the measurement target emission area in the light source unit 107 at the emission intensity obtained from the emission intensity calculation unit 105, and the processing is then terminated.

<Change in Control Range of Emission Intensity>

Figure 4:
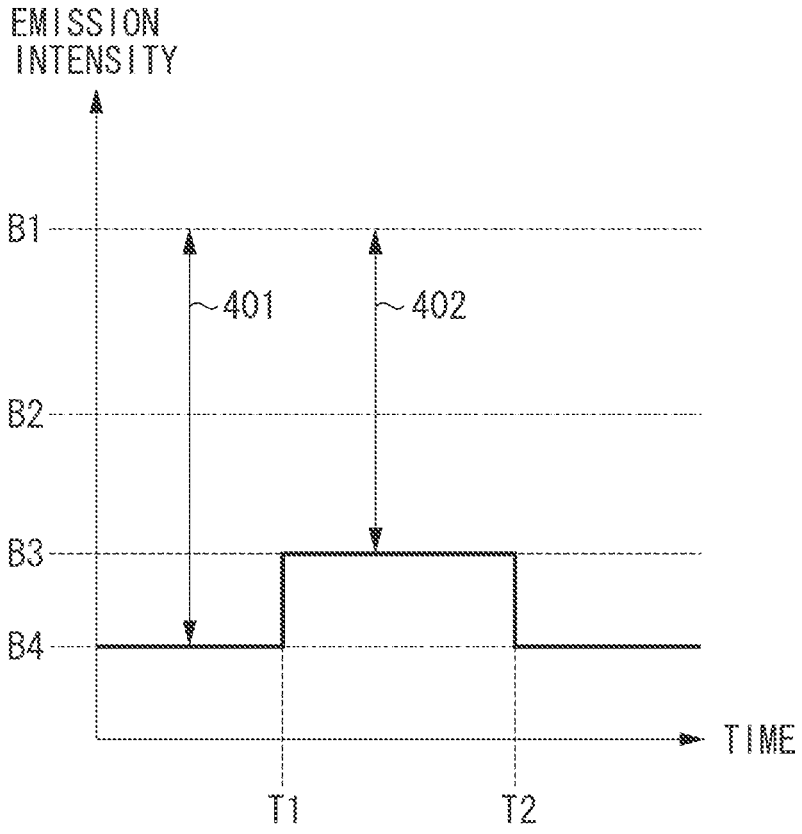
FIG. 4 is a graph illustrating a change in a control range of an emission intensity according to the first exemplary embodiment of the present disclosure.

Next, an example of the change in the control range of the emission intensity of the measurement target emission area in the light source unit 107 through the measurement processing carried out in the monitor 100 according to the first exemplary embodiment will be described with reference to FIG. 4. FIG. 4 is a graph schematically illustrating the change in the control range of the emission intensity of the measurement target emission area in the light source unit 107 through the measurement processing described with reference to FIG. 3. The horizontal axis of the graph represents the time, and the vertical axis represents the emission intensity. In addition, the respective distances between emission intensities B1, B2, B3, and B4 on the vertical axis of the graph in FIG. 4 are differentiated from the distances based on the values described below as examples, for the easy understanding of the description, and as is the case with the graphs in FIGS. 6 and 8 described below.

T1 on the horizontal axis indicates a timing at which step S302 starts in the measurement processing, and T2 indicates a timing at which step S305 ends in the measurement processing. B1 on the vertical axis indicates, for example, the maximum luminance, which has been set in advance by a user, at which the monitor 100 can display an image when the user uses the monitor 100. B2 indicates an upper limit value of the emission intensity at which the misadjusted black level is not noticeable in an image displayed on the display unit 104. Values calculated based, for example, on quality assurance guidelines for medical monitors may be employed as the aforementioned values. For example, a case where the monitor 100 is based on the regulations in "JESRA X-0093" of the Japan Medical Imaging and Radiological Systems Industries Association (JIRA) Standards will be described. In this case, if the assurance grade of the monitor 100 is the assurance grade 1, the contrast ratio of the monitor 100 is regulated to satisfy $Lmax/Lmin \geq 250$. In other words, according to the regulations in "JESRA X-0093", Lmin has to satisfy $Lmin \leq Lmax/250$. Here, Lmax corresponds to the maximum luminance at which the monitor 100 can display an image during use and corresponds to B1. Meanwhile, Lmin corresponds to the minimum luminance of the monitor 100 and is set to satisfy $Lmin \leq Lmax/250$. Thus, in this case, if the user sets the maximum luminance at which the monitor 100 can display an image to 500 cd/m$^2$ (B1) to use the monitor 100, Lmin has to be set to equal to or less than 2 cd/m$^2$. In other words, according to the regulations in "JESRA X-0093", if the assurance grade of the monitor 100 is the assurance grade 1, 2 cd/m$^2$ corresponds to the upper limit value of the emission intensity at which the misadjusted black level is not noticeable in an image displayed on the display unit 104. Here, B2 can be obtained through $B2=Lmax/250$ (dividing Lmax by 250), and B2=2 cd/m$^2$ is obtained in the present exemplary embodiment.

Next, a case where the assurance grade of the monitor 100 is the assurance grade 2 of the regulations in "JESRA X-0093" will be described. In this case, the contrast ratio of the monitor 100 is regulated to satisfy $Lmax/Lmin \geq 100$. Therefore, based on the above expression, B2 can be obtained through $B2=Lmax/100$ (dividing Lmax by 100), and if the user sets the maximum luminance at which the monitor 100 can display an image to 500 cd/m$^2$ (B1) to use the monitor 100, B2=5 cd/m$^2$ is obtained.

Next, a case where the monitor 100 is based on the regulations in "AAPM TG18", which is a standard relating to the performance of medical monitors in the United States, will be described. In this case, if the assurance grade of the monitor 100 is primary, the contrast ratio of the monitor 100 is regulated to satisfy $Lmax/Lmin \geq 250$. Therefore, based on the above expression, B2 can be obtained through $B2=Lmax/250$ (dividing Lmax by 250), and if the user sets the maximum luminance at which the monitor 100 can display an image to 500 cd/m$^2$ (B1) to use the monitor 100, B2=2 cd/m$^2$ is obtained. On the other hand, if the assurance grade of the monitor 100 is secondary of the regulations in "AAPM TG18", the contrast ratio of the monitor 100 is regulated to satisfy Lmax/Lmin≥100. Therefore, based on the above expression, B2 can be obtained through B2=Lmax/100 (dividing Lmax by 100), and if the user sets the maximum luminance at which the monitor 100 can display an image to 500 cd/m$^2$ (B1) to use the monitor 100, B2=5 cd/m$^2$ is obtained.

Next, a case where the monitor 100 is based on the regulations in "IPEM Report 91", which is a standard relating to the performance of medical monitors in the United Kingdom, will be described. In this case, the contrast ratio of the monitor 100 is regulated to satisfy Lmax/Lmin≥250. Therefore, based on the above expression, B2 can be obtained through B2=Lmax/250 (dividing Lmax by 250), and if the user sets the maximum luminance at which the monitor 100 can display an image to 500 cd/m$^2$ (B1) to use the monitor 100, B2=2 cd/m$^2$ is obtained.

Subsequently, a case where the monitor 100 is based on the regulations in "EUREF", which is a guideline relating to mammography in Europe, will be described. In this case, if the assurance grade of the monitor 100 is primary, the contrast ratio of the monitor 100 is regulated to satisfy Lmax/Lmin≥250. Therefore, based on the stated expression, B2 can be obtained through B2=Lmax/250 (dividing Lmax by 250), and if the user sets the maximum luminance at which the monitor 100 can display an image to 500 cd/m$^2$ (B1) to use the monitor 100, B2=2 cd/m$^2$ is obtained. On the other hand, if the assurance grade of the monitor 100 is secondary of the regulations in "EUREF", the contrast ratio of the monitor 100 is regulated to satisfy Lmax/Lmin≥100. Therefore, based on the stated expression, B2 can be obtained through B2=Lmax/100 (dividing Lmax by 100), and if the user sets the maximum luminance at which the monitor 100 can display an image to 500 cd/m$^2$ (B1) to use the monitor 100, B2=5 cd/m$^2$ is obtained.

There is a case where even if the light source unit 107 is controlled to emit light at the maximum luminance set in advance by the user, the light source unit 107 does not emit light at the set maximum luminance due to deterioration over time of a light source included in the light source unit 107. For example, in a case where the monitor 100 is based on the regulations in "JESRA X-0093 (assurance grade 1)", as described above, there is a case where even if the user sets the maximum luminance at which the monitor 100 can display an image to 500 cd/m$^2$ (B1) to use the monitor 100, the light source unit 107 emits light at an actual emission intensity of only 450 cd/m$^2$. In such a case, B2 can be obtained with Lmax set to 450 cd/m$^2$. In other words, in the present exemplary embodiment, the maximum luminance at which the monitor 100 can display an image may not only be the maximum luminance set by the user but also be the actual emission luminance of the light source unit 107 obtained when the light source unit 107 is controlled to emit light at the set maximum luminance.

Although B1 has been described as the maximum luminance of the monitor 100 set in advance by the user in the present exemplary embodiment, it is not limited thereto. The monitor 100 may include an external light sensor or the like, and the monitor 100 may automatically set the maximum luminance at which the monitor 100 can display an image in accordance with a detection value of the external light sensor. In addition, although the methods for calculating B2 based on the regulations in Japan, the United States, the United Kingdom, and Europe have been described as examples according to the present exemplary embodiment, the methods for calculating B2 are not limited thereto. B2 may be calculated based on a condition (mathematical expression) set through the standard in each country. Furthermore, although B2 has been calculated as a value that is equal to the maximum value of Lmin in the present exemplary embodiment, B2 does not need to be a value that is equal to the maximum value of Lmin as long as B2 is a value that is close to Lmin.

B3 on the vertical axis indicates a lower limit value of the emission intensity, stored in the storage unit 111, at which the sensor unit 109 can measure the characteristic value of the display unit 104. B3, which is the lower limit value of the emission intensity at which the sensor unit 109 can measure the characteristic value of the display unit 104, is set to a value that does not exceed B2. In addition, B4 on the vertical axis indicates a emission intensity corresponding to darkest image data (i.e., darkest portion in the image data) in a calculation logic of the emission intensity in the emission intensity calculation unit 105.

As illustrated in FIG. 4, during normal use of the monitor 100, the emission intensity of a luminous area directly below the sensor unit 109 in the light source unit 107 is controlled within a control range 401 ranging from the upper limit value B1 to the lower limit value B4. As the measurement processing is carried out, the emission intensity of the measurement target emission area in the light source unit 107 is controlled within a control range 402 ranging from the upper limit value B1 to the lower limit value B3. In addition, during the measurement processing, the lower limit value of the control range of the emission intensity of the measurement target emission area in the light source unit 107 is set so as not to exceed B2, which is the upper limit value of the emission intensity at which the misadjusted black level is not noticeable in an image displayed on the display unit 104. In this manner, in the present exemplary embodiment, during the measurement processing, the lower limit value of the control range of the emission intensity of the measurement target emission area in the light source unit 107 is set to B3, which is the lower limit value of the emission intensity at which the sensor unit 109 can measure the characteristic value of the display unit 104, and is also set so as not to exceed B2, which is the upper limit value of the emission intensity at which the misadjusted black level is not noticeable in an image displayed on the display unit 104. Such a configuration allows the sensor unit 109 to measure the characteristic value of the display unit 104 with high accuracy while the occurrence of the misadjusted black level is suppressed to a minimum.

Although the above description is based on an assumption that the lower limit value of the emission intensity at which the sensor unit 109 can measure the characteristic value of the display unit 104 corresponding to B3 in FIG. 4 is a fixed value in the first exemplary embodiment, it is not limited thereto. B3, which is the lower limit value of the emission intensity at which the sensor unit 109 can measure the characteristic value of the display unit 104, may be a value that dynamically varies. For example, B3, which is the lower limit value of the emission intensity at which the sensor unit 109 can measure the characteristic value of the display unit 104, may be calculated from information, stored in advance in the storage unit 111, relating to the ideal display characteristics of the display unit 104.

As described above, the monitor 100 according to the present exemplary embodiment is configured in such a manner that, in a case where the sensor unit 109 cannot measure the characteristic value of the measurement target emission area in the light source unit 107 since the emission intensity of the measurement target emission area is too low when the sensor unit 109 is to measure the characteristic value of the display unit 104, the lower limit value of the control range of the emission intensity of the measurement target luminous area in the light source unit 107 is controlled to rise to a value at which the sensor unit 109 can measure the characteristic value of the display unit 104. In other words, the emission luminance of the light source unit 107 is controlled so that the emission luminance for the measurement target emission area does not fall below B3 (value at which the sensor unit 109 can measure the characteristic value of the display unit 104), which is a value greater than the minimum emission luminance calculated by the emission intensity calculation unit 105, when the sensor unit 109 measures the characteristic value during the local dimming control. In addition, the lower limit value of the control range of the emission intensity of the measurement target emission area in the light source unit 107 is controlled and set so as not to exceed the upper limit value of the emission intensity at which the misadjusted black level is not noticeable in an image displayed on the display unit 104. Through the control described above, the sensor unit 109 can measure the characteristic value of the display unit 104 with high accuracy while the occurrence of the misadjusted black level is suppressed to a minimum, and the control unit 101 can derive the display characteristics of the display unit 104 with accuracy through calculation processing based on the obtained characteristic value. As a result, the accuracy of calibration using the measurement value can be improved as compared to that of an existing technique.

In the processing described in the first exemplary embodiment, the sensor unit 109 measures the characteristic value of the display unit 104 while the lower limit value of the control range of the emission intensity of the measurement target emission area is raised to suppress the occurrence of the misadjusted black level to a minimum during the measurement processing, and the control unit 101 derives the display characteristics of the display unit 104 based on the obtained characteristic value. However, if the lower limit value of the control range of the emission intensity of the measurement target emission area is raised suddenly (i.e., if the processing of suddenly raising the emission intensity of the measurement target emission area is carried out) as in the first exemplary embodiment, the user's vision may sensitively react to a sudden change in the display luminance. In other words, the misadjusted black level may become noticeable to some extent due to the sudden change in the luminance. Therefore, in an example described in a second exemplary embodiment, the control range of the emission intensity of the light source unit 107 is controlled to change so that the emission intensity of a measurement target emission area 501 gradually rises in the measurement processing according to the first exemplary embodiment. This allows the misadjusted black level to be less noticeable in an area in the display unit 104 around the divided area corresponding to the measurement target emission area 501.

An image display apparatus according to the present exemplary embodiment is similar in configuration to the image display apparatus 100 according to the first exemplary embodiment, and thus reference characters indicated in FIG. 1 will be used in the descriptions thereof. Thus, the descriptions of the configurations are omitted. In addition, the automatic calibration processing and the measurement processing in the monitor 100 are similar to those of the first exemplary embodiment in terms of the flow of the processing, such as the order of the processes, and thus the descriptions of the flow will be omitted.

FIG. 5A schematically illustrates a state in which an image based on image data is displayed on the display unit 104 of the monitor 100 and the processing of measuring the display characteristics of the display unit 104 has not been carried out, whereas FIG. 5B schematically illustrates a state in which such processing is being carried out. Although FIGS. 5A and 5B illustrate an example in which the image based on the image data is displayed in a left side area of the display area of the display unit 104 and the sensor unit 109 is disposed facing an area that is to the right of the center of the display unit 104, it is not limited thereto. The image based on the image data may be displayed anywhere within the display area of the display unit 104, and the sensor unit 109 may be disposed anywhere facing the display unit 104.

FIG. 5A illustrates an external view of the monitor 100 in a state in which the measurement processing is not carried out and the light emission state of each of the emission areas in the light source unit 107. Since the emission intensity calculation unit 105 has calculated the emission intensity so that the luminance of an area corresponding to the dark portion in the image data becomes lower, the light emission state of each of the emission areas in the light source unit 107 is controlled so that the emission intensity at the right side of the screen is lower, as illustrated in FIG. 5A. Although the dotted lines dividing the display area are indicated in the display unit 104 illustrated in FIG. 5A in order to illustrate the divided areas, in reality, the dotted lines are not indicated on the display unit 104.

FIG. 5B illustrates an external view of the monitor 100 in a state in which the measurement processing is being carried out and the light emission state of each of the emission areas in the light source unit 107. In this case, the measurement target emission area 501, which is an emission area directly facing the sensor unit 109, in the light source unit 107 illustrated in FIG. 5B is controlled to emit light at an emission intensity that is higher than that in the state illustrated FIG. 5A through the processing in step S302 of the measurement processing. Thus, as illustrated in FIG. 5B, an area in the display unit 104 corresponding to the measurement target emission area 501 can be viewed as the misadjusted black level to some extent.

<Change in Control Range of Emission Intensity>

Figure 6:
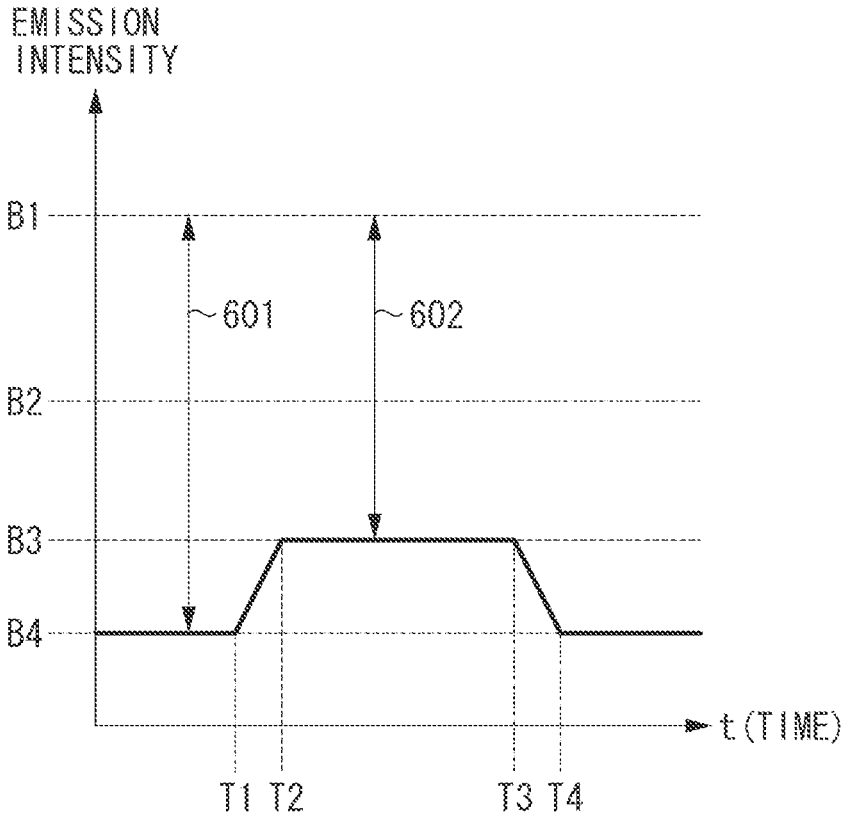
FIG. 6 is a graph illustrating a change in a control range of an emission intensity according to the second exemplary embodiment of the present disclosure.

Next, an example of the change in the control range of the emission intensity of the measurement target emission area 501 in the light source unit 107 in the measurement processing carried out in the monitor 100 according to the second exemplary embodiment will be described with reference to FIG. 6. FIG. 6 is a graph schematically illustrating the change in the control range of the emission intensity of the measurement target emission area 501 in the measurement processing described in the first exemplary embodiment with reference to FIG. 3. The horizontal axis of the graph represents time, and the vertical axis represents emission intensity.

T1 on the horizontal axis indicates a timing at which step S302 starts in the measurement processing, and T2 indicates a timing at which step S302 ends in the measurement processing. In other words, the period from T1 to T2 corresponds to a period in which the processing of changing the lower limit value of the emission intensity of the measurement target emission area 501 prior to carrying out the measurement processing (hereinafter, referred to as a period of lower limit value changing processing prior to the measurement processing) is carried out. T3 indicates a timing at which step S305 starts in the measurement processing, and T4 indicates a timing at which step S305 ends in the measurement processing. In other words, the period from T3 to T4 corresponds to a period in which the processing of changing the lower limit value of the emission intensity of the measurement target emission area 501 after carrying out the measurement processing (hereinafter, referred to as a period of lower limit value changing processing after the measurement processing) is carried out. B1, B2, B3, and B4 on the vertical axis are the same as those of the first exemplary embodiment, and thus descriptions thereof will be omitted.

As illustrated in FIG. 6, during normal use of the monitor 100, the emission intensity of the measurement target emission area 501 is controlled within a control range 601 ranging from the upper limit value B1 to the lower limit value B4. Then, during the period of the lower limit value changing processing prior to the measurement processing, i.e., from T1 to T2, the control range of the emission intensity of the measurement target emission area 501 is controlled so that the lower limit value of the control range of the emission intensity of the measurement target luminous area 501 changes gradually from B4 to B3 (i.e., so that the lower limit value rises linearly as illustrated in FIG. 6). Thus, during the measurement processing, the emission intensity of the measurement target luminous area 501 is controlled within a control range 602 ranging from the upper limit value B1 to the lower limit value B3. Then, during the period of the lower limit value changing processing after the measurement processing, the control range of the emission intensity of the measurement target emission area 501 is controlled so that the lower limit value of the control range of the emission intensity of the measurement target luminous area 501 changes gradually from B3 to B4 (i.e., so that the lower limit value falls linearly back to the lower limit value of the original control range of the emission intensity as illustrated in FIG. 6). The above control of gradually changing the control range of the emission intensity is implemented by the emission intensity calculation unit 105 carrying out control of gradually changing the control range in step S302 and in step S305.

As described above, in the present exemplary embodiment, when the sensor unit 109 is to measure the characteristic value of the display unit 104, the lower limit value of the control range of the emission intensity of the measurement target emission area 501 is controlled to gradually rise. In addition, when the sensor unit 109 has finished measuring the characteristic value of the display unit 104, the lower limit value of the control range of the emission intensity of the measurement target emission area 501 is controlled to gradually return to the original lower limit value. Such a configuration makes it possible to prevent the emission intensity from changing suddenly at the time of the measurement processing. As a result, a situation in which the misadjusted black level becomes noticeable can be suppressed.

Although, in the example of the present exemplary embodiment, the lower limit value of the control range of the emission intensity of the measurement target emission area 501 is controlled to rise gradually and linearly, as illustrated in FIG. 6, in the period of the lower limit value changing processing prior to the measurement processing, it is not limited thereto. For example, in FIG. 6, the lower limit value of the control range of the emission intensity of the measurement target emission area 501 may be raised gradually and stepwise or may be raised gradually in a curve. In addition, although, in the example of the present exemplary embodiment, the lower limit value of the control range of the emission intensity of the measurement target emission area 501 is controlled to fall gradually and linearly, as illustrated in FIG. 6, in the period of the lower limit value changing processing after the measurement processing, it is not limited thereto. In FIG. 6, the lower limit value of the control range of the emission intensity of the measurement target emission area 501 may be lowered gradually and stepwise or may be lowered gradually in a curve. When the lower limit value of the control range of the emission intensity of the measurement target emission area 501 is lowered, the lower limit value may be lowered suddenly, as in the first exemplary embodiment. As long as the lower limit value of the control range of the emission intensity of the measurement target emission area 501 is controlled to gradually rise at least in the period of the lower limit value changing processing prior to the measurement processing, a situation in which the misadjusted black level becomes noticeable can be suppressed.

An image display apparatus according to a third exemplary embodiment is similar in configuration to the image display apparatus according to the second exemplary embodiment, and thus reference characters indicated in FIG. 1 will be used in the descriptions. Thus, the descriptions of the configurations are omitted. In addition, the automatic calibration processing and the measurement processing in the monitor 100 are similar to those of the second exemplary embodiment in terms of the flow of the processing, such as the order of the processes, and thus the descriptions of the flow will be omitted.

In an example of the present exemplary embodiment, the emission intensity in an emission area around the measurement target emission area 501 is also raised gradually in order to cause the misadjusted black level in an area in the display unit 104 corresponding to the measurement target emission area 501 to become even less noticeable than that in the second exemplary embodiment.

Figure 7:
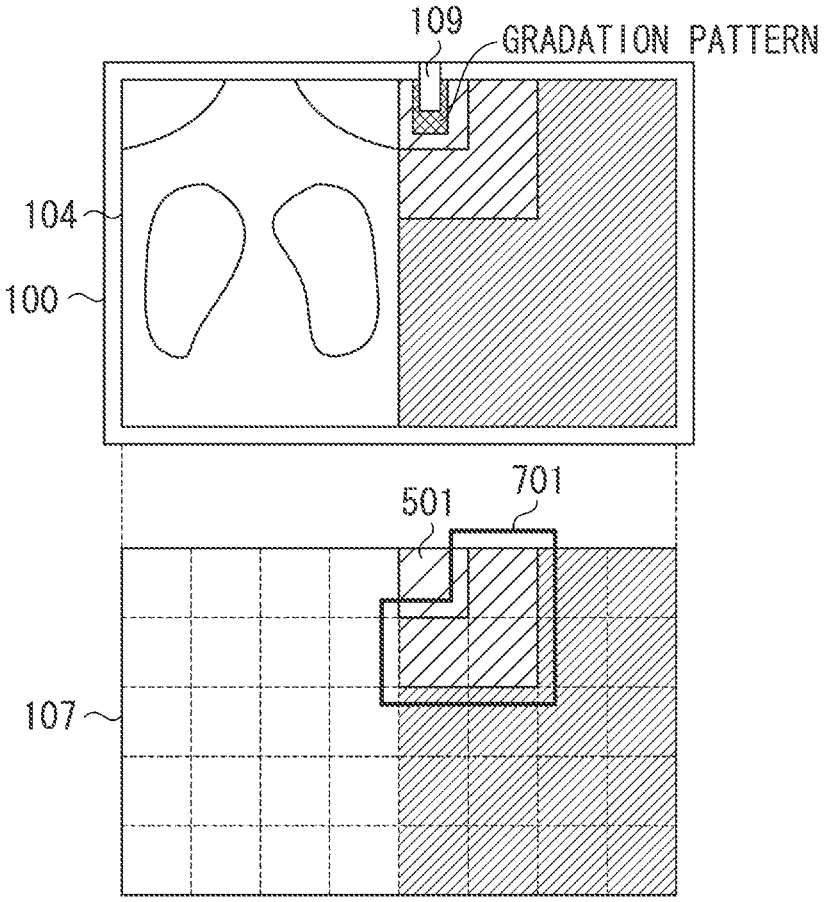
FIG. 7 is a diagram illustrating an overview of control according to a third exemplary embodiment of the present disclosure.

Control of each of the emission areas in the light source unit 107 during the measurement processing according to the third exemplary embodiment will be described with reference to FIG. 7. FIG. 7 illustrates an external view of the monitor 100 while the measurement processing is being carried out and the light emission state of each of the emission areas in the light source unit 107 according to the present exemplary embodiment. In this case, the measurement target emission area 501 illustrated in FIG. 7 is controlled to emit light at a emission intensity that is higher than that of the state illustrated in FIG. 5A, as in the state illustrated in FIG. 5B in the second exemplary embodiment. In the present exemplary embodiment, the light source control unit 106 controls the light source unit 107 so that an emission area 701 adjacent to the measurement target emission area 501 (hereinafter, referred to as an adjacent emission area 701) emits light at an emission intensity that is lower than the emission intensity of the measurement target emission area 501 (i.e., at emission luminance that is lower than the emission luminance for the measurement target emission area 501) and also at an emission intensity that is higher than the emission intensity of an emission area corresponding to a dark image area around the adjacent emission area 701 (i.e., at emission luminance that is higher than the emission luminance for the emission area corresponding to the dark image area around the adjacent emission area 701). As illustrated in FIG. 7, an emission area corresponding to a bright image area (i.e., area of a displayed image on the left side of the screen in FIG. 7) is not included in the adjacent emission area 701 even if the emission area is adjacent to the measurement target emission area 501. Such control can be implemented, for example, by the emission intensity calculation unit 105 determining that an emission area that is controlled to emit light at an emission intensity that is greater than a threshold value stored in the storage unit 111 is not included in the adjacent emission area 701. In other words, the adjacent emission area 701 is set by the emission intensity calculation unit 105.

<Change in Control Range of Emission Intensity>

Figure 8:
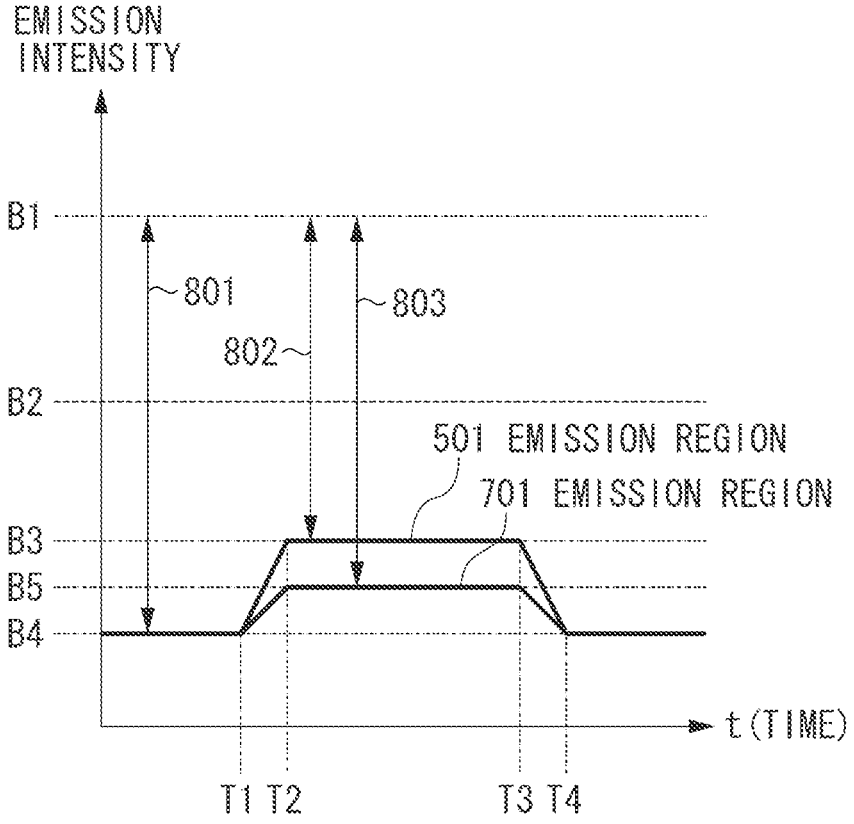
FIG. 8 is a graph illustrating a change in a control range of an emission intensity according to the third exemplary embodiment of the present disclosure.
Figure 9A:
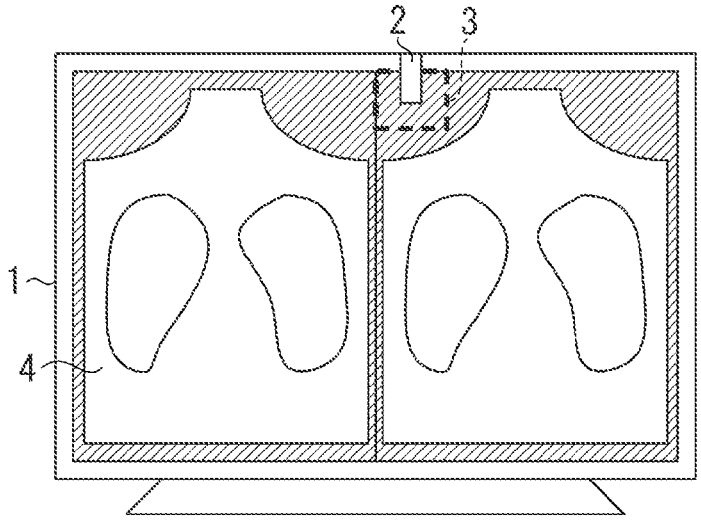
FIG. 9A PRIOR ART
FIGS. 9A and 9B are diagrams illustrating a problem to be solved by the present disclosure.
Figure 9B:
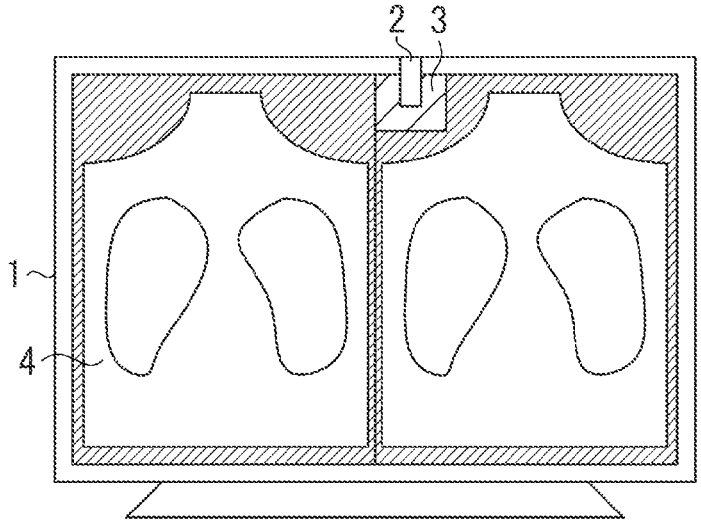
FIG. 9B PRIOR ART

Next, an example of the change in the control range of the emission intensity of each of the measurement target luminous area 501 and the adjacent emission area 701 in the measurement processing carried out in the monitor 100 according to the present exemplary embodiment will be described with reference to FIG. 8. FIG. 8 is a graph schematically illustrating the change in the control range of the emission intensity of each of the measurement target luminous area 501 and the adjacent emission area 701 in the measurement processing described in the first exemplary embodiment with reference to FIG. 3. The horizontal axis of the graph represents time, and the vertical axis represents emission intensity.

T1, T2, T3, and T4 on the horizontal axis are the same as those of the second exemplary embodiment, and thus descriptions thereof will be omitted. In addition, B1, B2, B3, and B4 on the vertical axis are the same as those of the first exemplary embodiment, and thus descriptions thereof will be omitted. Furthermore, B5 on the vertical axis is set to a value that is lower than B3 and greater than B4.

As illustrated in FIG. 8, during normal use of the monitor 100, the control range of the emission intensity of the measurement target emission area 501 is set to a control range 801 ranging from the upper limit value B1 to the lower limit value B4. Then, in the period of the lower limit value changing processing prior to the measurement processing, i.e., from T1 to T2, the control range of the emission intensity of the measurement target emission area 501 is set so that the lower limit value of the control range of the emission intensity of the measurement target emission area 501 changes gradually from B4 to B3 (i.e., so that the lower limit value rises linearly as illustrated in FIG. 8), as in the second exemplary embodiment. In addition, during normal use of the monitor 100, the control range of the emission intensity of the adjacent emission area 701 is set to the control range 801 ranging from the upper limit value B1 to the lower limit value B4. Then, in the period of the lower limit value changing processing prior to the measurement processing, i.e., from T1 to T2, the control range of the emission intensity of the adjacent emission area 701 is set so that the lower limit value of the control range of the emission intensity of the adjacent emission area 701 changes gradually from B4 to B5 (i.e., so that the lower limit value raises linearly as illustrated in FIG. 8), as in the measurement target emission area 501. During the measurement processing, the control range of the emission intensity of the measurement target emission area 501 is set to a control range 802 ranging from the upper limit value B1 to the lower limit value B3. Then, in the period of the lower limit value changing processing after the measurement processing, the control range of the emission intensity of the measurement target emission area 501 is set so that the lower limit value of the control range of the emission intensity of the measurement target emission area 501 changes gradually from B3 to B4 (i.e., so that the lower limit value falls linearly back to the lower limit value of the original control range of the emission intensity as illustrated in FIG. 8). Meanwhile, during the measurement processing, the control range of the emission intensity of the adjacent emission area 701 is set to a control range 803 ranging from the upper limit value B1 to the lower limit value B5, which is a value smaller than B3 and greater than B4. Then, in the period of the lower limit value changing processing after the measurement processing, the control range of the emission intensity of the adjacent emission area 701 is set so that the lower limit value of the control range of the emission intensity of the adjacent emission area 701 changes gradually from B5 to B4 (i.e., so that the lower limit value falls linearly back to the lower limit value of the original control range of the emission intensity as illustrated in FIG. 8). By setting the control ranges as described above, in the present exemplary embodiment, while the sensor unit 109 measures the characteristic value of the display unit 104, the emission intensity of the adjacent emission area 701 can be controlled to an emission intensity that is lower than the emission intensity of the measurement target emission area 501 and greater than the emission intensity of an emission area corresponding to a dark image area around the adjacent emission area 701. With such a configuration, regarding how an image in an area directly below the sensor unit 109 looks at the time of the measurement processing, since areas around the area are controlled to become darker gradually, a situation in which the misadjusted black level becomes noticeable can be suppressed.

Although, in the example of the present exemplary embodiment, the setting of the control range of the emission intensity of only the adjacent emission area 701 that is adjacent to the measurement target emission area 501 is changed, it is not limited thereto. For example, the control range of the emission intensity of each of the emission areas around the adjacent emission area 701 in the screen may also be controlled so that the emission intensity of the emission area gradually falls as its distance from the measurement target emission area 501 increases.

Thus far, while exemplary embodiments of the present disclosure have been described with reference to the drawings, the present disclosure is not limited to these examples. For example, although an example in which the image display apparatus is a liquid crystal display apparatus including a liquid crystal panel has been described according to the above exemplary embodiments, the image display apparatus is not limited to a liquid crystal display apparatus. For example, instead of a liquid crystal panel, a display panel that includes display elements other than the liquid crystal elements to serve as display elements that transmit light from the light source unit may be used.

In addition, although an example in which the image display apparatus is a monitor has been described according to the above exemplary embodiments, it is not limited thereto. An apparatus such as a television receiving apparatus may be used as the image display apparatus as long as such an apparatus has a function of displaying an image based on image data. In addition, although an example in which the sensor unit is integrated into the monitor has been described according to the above exemplary embodiment, it is not limited thereto. The sensor unit may be provided separately from the monitor.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-136170 filed Jun. 28, 2013 and No. 2014-106156 filed May 22, 2014, which are hereby incorporated by reference herein in their entirety.

What is claimed is:

1. An image display apparatus comprising:

a display panel configured to display an image based on image data on a screen including a plurality of areas;

a backlight capable of individually controlling emission brightness for each of the plurality of areas based on the image data;

a sensor disposed facing the screen, and configured to measure a characteristic value relating to display characteristics of the display panel; and a processor configured to, in a case where the sensor measures the characteristic value, determine whether first emission brightness for a first area facing the sensor is lower than a first value at which the sensor cannot measure the characteristic value, and set second emission brightness which is equal to or greater than the first value as emission brightness for the first area in a case where the first emission brightness is lower than the first value, wherein, the processor sets the second emission brightness for the first area, while the sensor measures the characteristic value, and sets the first emission brightness for the first area, after the sensor measures the characteristic value, and wherein the first emission brightness is a value determined based on an image displayed on the first area, and the second emission brightness is a predetermined value at which the sensor can measure the characteristic value.

2. The image display apparatus according to claim 1, wherein, the second emission brightness is equal to or greater than the first value and equal to or lower than a second value.

3. The image display apparatus according to claim 2, wherein the second value is a value obtained by dividing maximum brightness of the backlight set in advance by 250.

4. The image display apparatus according to claim 2, wherein the second value is a value obtained by dividing maximum brightness of the backlight set in advance by 100.

5. The image display apparatus according to claim 1, wherein, when the sensor measures the characteristic value, the processor controls the emission brightness for the first area to gradually rise, in a case where the emission brightness for the first area is lower than the first value.

6. The image display apparatus according to claim 1, wherein the processor controls the emission brightness of the first area, which has been raised to reach or exceed the first value, to gradually fall in response to the sensor finishing measuring the characteristic value.

7. The image display apparatus according to claim 1, wherein, when the sensor measures the characteristic value, the processor raises emission brightness for a second area adjacent to the first area, in a case where the emission brightness for the first area is lower than the first value.

8. The image display apparatus according to claim 1, wherein the first value is a lower limit value of emission brightness at which the sensor can measure the characteristic value.

9. The image display apparatus according to claim 1, wherein the display characteristics are at least one of gamma characteristics, color characteristics, and brightness characteristics.

10. The image display apparatus according to claim 1, wherein the characteristic value is at least one of a chromaticity value and a brightness value.

11. The image display apparatus according to claim 1, wherein the second emission brightness is a predetermined fixed value.

12. A method for controlling an image display apparatus that includes a display panel configured to display an image on a screen including a plurality of areas based on image data and a backlight capable of independently controlling emission brightness for each of the plurality of areas based on the image data, the method comprising:

measuring a characteristic value relating to display characteristics of the display panel by using a sensor facing the screen;

in a case where the sensor is measuring the characteristic value, determining whether first emission brightness for a first area facing the sensor is lower than a first value at which the sensor cannot measure the characteristic value, and setting second emission brightness which is equal to or greater than the first value as emission brightness for the first area in a case where the first emission brightness is lower than the first value;

setting the second emission brightness for the first area, while the sensor measures the characteristic value; and setting the first emission brightness as the emission brightness for the first area, after the sensor measures the characteristic value, wherein the first emission brightness is a value determined based on an image displayed on the first area, and the second emission brightness is a predetermined value at which the sensor can measure the characteristic value.

13. The method for controlling the image display apparatus according to claim 12, wherein the second emission brightness is set so that the emission brightness for the first area is equal to or greater than the first value and equal to or lower than a second value.

14. The method for controlling the image display apparatus according to claim 13, wherein the second value is a value obtained by dividing maximum brightness of the backlight set in advance by 250.

15. The method for controlling the image display apparatus according to claim 13, wherein the second value is a value obtained by dividing maximum brightness of the backlight set in advance by 100.

16. The method for controlling the image display apparatus according to claim 12, wherein when the sensor measures the characteristic value, the emission brightness for the first area is controlled to gradually rise, in a case where the emission brightness for the first area is lower than the first value.

17. The method for controlling the image display apparatus according to claim 12, wherein the emission brightness for the first area, which has been raised to reach or exceed the first value, is controlled to gradually fall in response to the sensor finishing measuring the characteristic value.

18. The method for controlling the image display apparatus according to claim 12, wherein when the sensor measures the characteristic value, emission brightness for a second area adjacent to the first area is raised, in a case where the emission brightness for the first area is lower than the first value.

19. The method for controlling the image display apparatus according to claim 12, wherein the first value is a lower limit value of emission brightness at which the sensor can measure the characteristic value.

20. The method for controlling the image display apparatus according to claim 12, wherein the display characteristics are at least one of gamma characteristics, color characteristics, and brightness characteristics.

21. The method for controlling the image display apparatus according to claim 12, wherein the characteristic value is at least one of a chromaticity value and a brightness value.

22. The method for controlling the image display apparatus according to claim 12, wherein the second emission brightness is a predetermined fixed value.

* * * * *